US005502624A

United States Patent [19]

Tu

[11] Patent Number: 5,502,624

[45] Date of Patent: Mar. 26, 1996

[54] UMBRELLA WITH ALARMING AND LIGHTING FUNCTIONS

[76] Inventor: Yue-Feng Tu, No. 23, Alley 6, Lane 87, Fu-Der Street, Yang-Mei, Taoyuan Hsien, Taiwan

[21] Appl. No.: 374,304

[22] Filed: Jan. 18, 1995

[51] Int. Cl.[6] ..... A45B 3/02

[52] U.S. Cl. ..... 362/102; 362/800

[58] Field of Search ..... 362/102, 800; 135/16, 910

[56] References Cited

U.S. PATENT DOCUMENTS 4,031,381 6/1977 Carver ..... 362/102
4,860,179 8/1989 Mui et al. ..... 362/102
5,126,922 6/1992 Andreasen ..... 362/102
5,323,798 6/1994 Yang ..... 135/16

*Primary Examiner*—Ira S. Lazarus
*Assistant Examiner*—Alfred Basichas
*Attorney, Agent, or Firm*—Sherman and Shalloway

[57] ABSTRACT

The present invention relates to an umbrella with alarming and lighting functions wherein bulbs or light emitting diodes (LEDs) are installed on the top end of the shaft and on the tips of each of the ribs and powered via electrical leads from battery cells installed in the handle. The leads are installed inside the shaft and respective ribs. For ribs made of fiber glass or carbon fiber, copper wires are embedded during continuous forming process and contacts are provided on the pivotally connected nest whereby, electrical energy can be delivered to the bulbs or LEDs on the tips of each of the ribs to provide a visual warning alarm.

12 Claims, 6 Drawing Sheets

UMBRELLA WITH ALARMING AND LIGHTING FUNCTIONS

FIELD AND BACKGROUND OF THE INVENTION

The present invention relates to an umbrella with lighting and alarming functions and, in particular, to such an umbrella having bulbs or light emitting diodes (LEDs) installed on the top end of the shaft and on the tips of the ribs of the umbrella such that light rays are emitted from the bulbs or LEDs so as to ensure the safety of the users and to add a romantic touch to the umbrella.

An umbrella is an essential item for everyday life which is used for shelter from the rain during rainy days and for shading off sunshine during clear days. Umbrellas are used very frequently in Taiwan, an island located in the subtropic, where there are long hot and rainy seasons. Therefore, it is desirable to provide an umbrella which is both functional and practical for use.

There are many types of umbrellas. Typical examples include those disclosed in the following ROC Utility Model (UM) Applications: 79200612, entitled "Improved Tension Structure for Umbrellas"; 81209114, entitled "wind Force Relieving Device for Preventing Overturn of Umbrellas (II)"; and 79209937, entitled "An Umbrella Having foldable Outer Cover". Conventional umbrellas comprise ribs which are pivoted on a shaft by means of a nest and have pieces of fabric sewed on the ribs. The ribs can be made into either one segment in the simple form or into multiple segments in the foldable portable form. After improvements over the years, conventional umbrellas have become virtually perfect in mechanism and function with one disadvantage being that there is no alarming device on the umbrella due to technical restrictions such that in poor visibility during rainy days when vision is severely restricted, such umbrellas are not safe for the users to have shelter from the rain and may easily result in accidents, particularly at rainy nights. Therefore, it extremely desirable to have the umbrella equipped with a proper alarming device.

In view of the above drawback with conventional umbrellas, elaborate analyses, continued trials and tests have been made and, finally after numerous improvements, the umbrella with lighting and alarming functions of the present invention has been successfully developed.

SUMMARY OF THE INVENTION

Directed to the disadvantage found in umbrellas without an alarming device and to the importance of such an alarming device, the principal object of the present invention to provide an umbrella which has alarming and lighting functions. It is a further object to provide such functions by having bulbs or light emitting diodes (LEDs) installed on the tips of the ribs and on the top end of the shaft such that alarming light rays can be emitted in poor visibility during rainy days or nights so as to ensure the safety of the users.

The various features of novelty which characterize the invention are pointed out with particularity in the claims annexed to and forming a part of this disclosure. For a better understanding of the invention, its operative advantages and specific objects attained by its uses, reference is made to the accompanying drawings and descriptive matter in which preferred embodiments of the invention are illustrated.

DESCRIPTION OF THE PREFERRED EMBODIMENT

Figure 1:
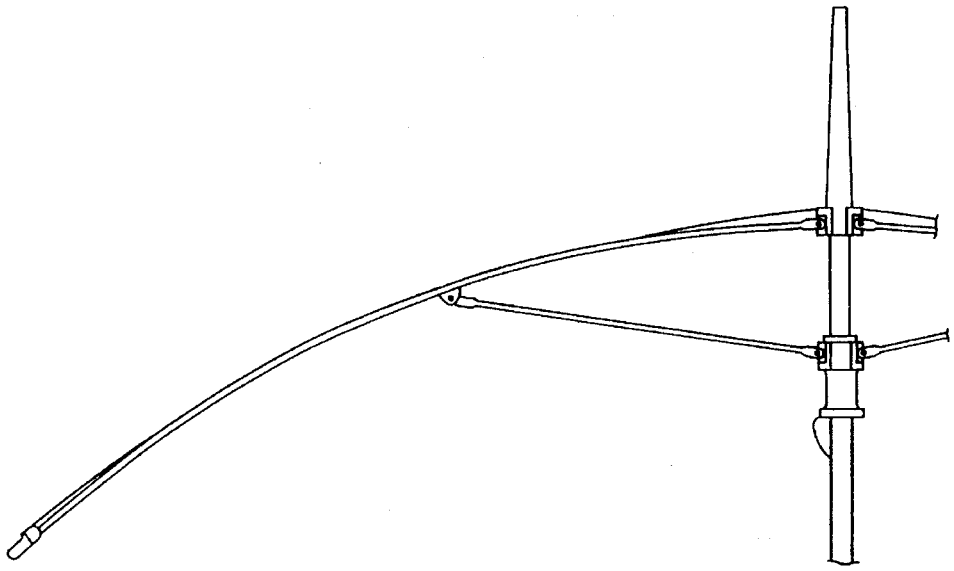
FIG. 1 PRIOR ART
FIG. 1 is a schematic view of a conventional umbrella.
Figure 2:
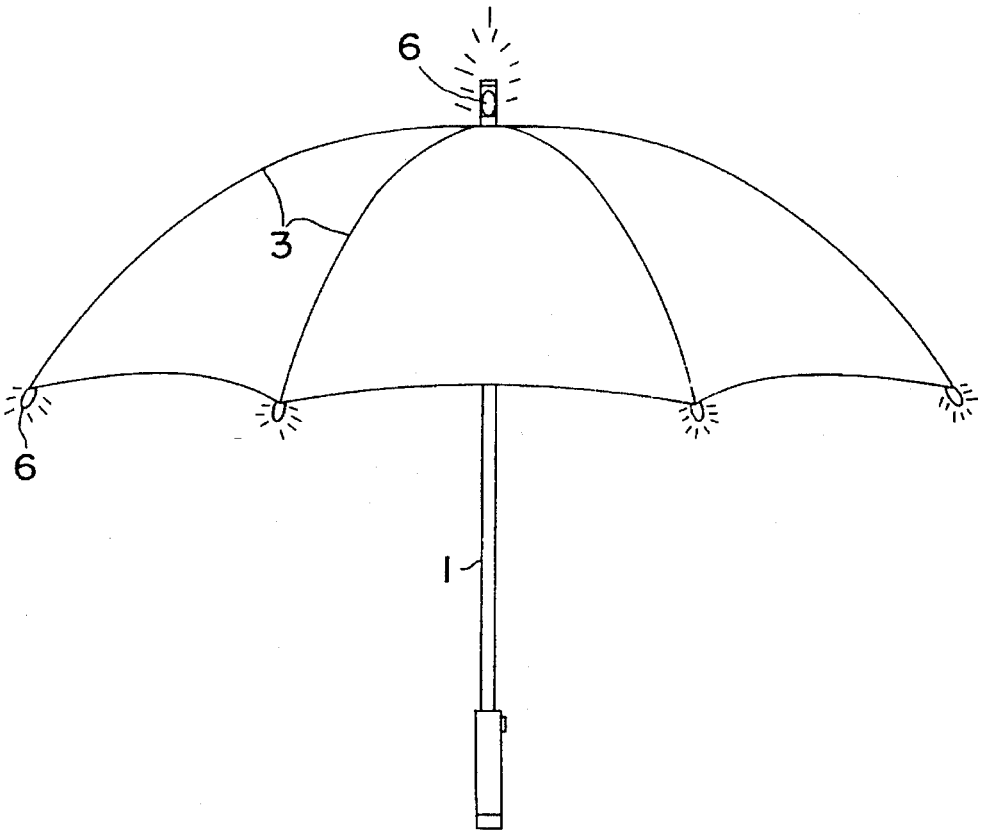
FIG. 2 is a schematic view of an embodiment of the present invention.

Referring to FIG. 2, there is shown the schematic view of an embodiment of the present invention. The appearance of the umbrella with alarming and lighting functions of the present invention is similar to that of conventional umbrellas. However, there are bulbs 6 or LEDs installed on the top end of the shaft 1 and on the tips of the ribs 3 such that alarming light rays visible to car drivers in poor vision and poor visibility on rainy days and nights are emitted so as to ensure the safety of the user. Preferably a bulb of higher brightness is used for the bulb on the top end of the shaft 1 such that it can be used as a flashlight after the umbrella is folded.

Figure 3:
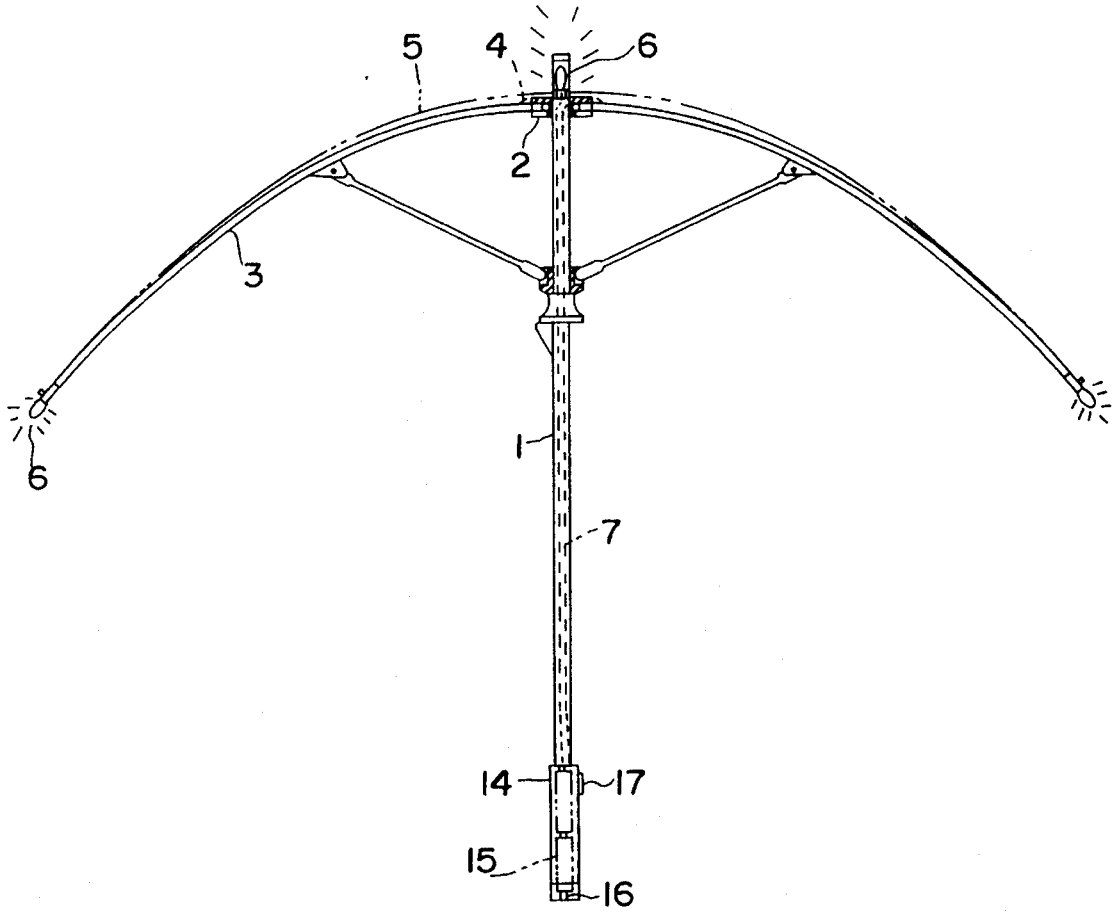
FIG. 3 is a schematic view showing the framework of the embodiment of the present invention.

Referring to FIG. 3, there is shown the schematic view of the framework of the embodiment of the present invention. The framework of the umbrella with alarming and lighting functions of the present invention is similar to that of conventional umbrellas. In the present invention, the umbrella is made up by having the ribs 3 pivotally connected near the top end of the shaft 1 by means of a nest 2, then placing a water resistant cap 4 on the top side of the nest, and finally laying pieces of fabric 5 over the top side of the ribs 3. In the present invention, however, bulbs 6 or LEDs are installed on the top end of the shaft 1 and on the tips of the ribs 3, respectively. The electrical energy required for the bulbs 6 or LEDs is provided by battery cells 15 installed in the handle 14 on the lower end of the shaft 1, the electrical energy from the cells 15 being delivered to the bulb 6 on the top end of the shaft 1 over wires 7 via a switch 17, and to the bulbs 6 via the nest 2 and the ribs 3.

Figure 4:
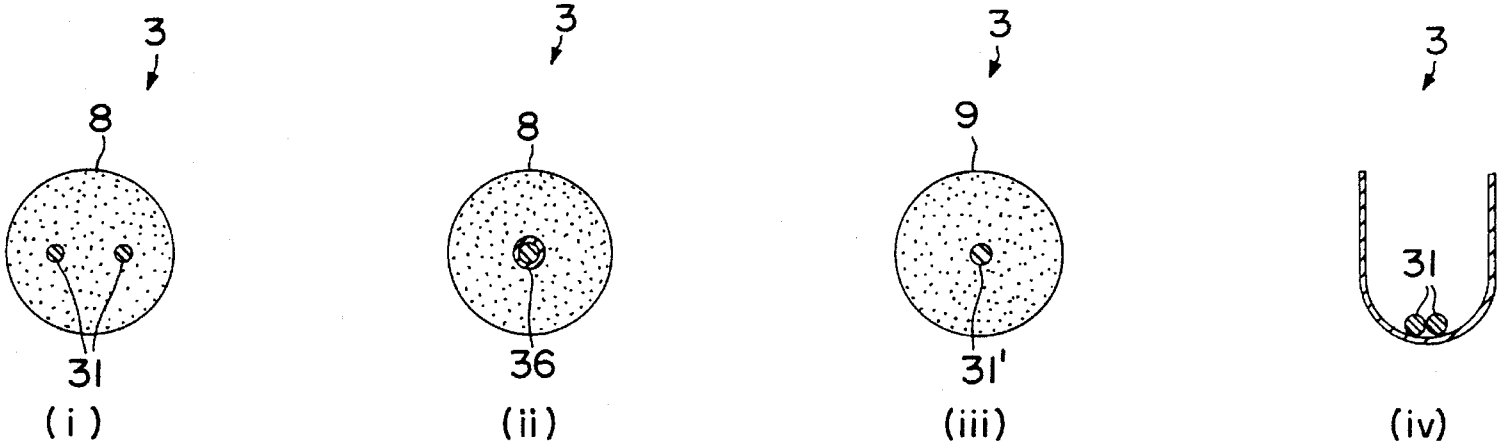
FIG. 4 is a cross section view showing various ribs suitable for use in the embodiment of the present invention.

Referring to FIG. 4, there is shown cross sectional views of various ribs suitable for use in the embodiment of the present invention. The ribs used in the present invention can be of cross sections as shown in FIG. 4 wherein (i) a pair of parallel leads 31 are shown embedded in a fiber glass rod 8; (ii) a coaxial cable 36 is shown embedded in the fiber glass rod 8; (iii) a lead 31' is shown embedded in a carbon fiber rod 9; and (iv) the parallel leads 31 are shown placed in grooved ribs 3. Electrical energy from the cells is delivered to the bulbs on the top end of the shaft and on the tips of the ribs by means of the leads. In the case of (iii), since a conductive carbon fiber material is used for the ribs which corresponds to a lead, it is required to have only one lead 31' to be embedded for delivering electrical energy.

Figure 5:
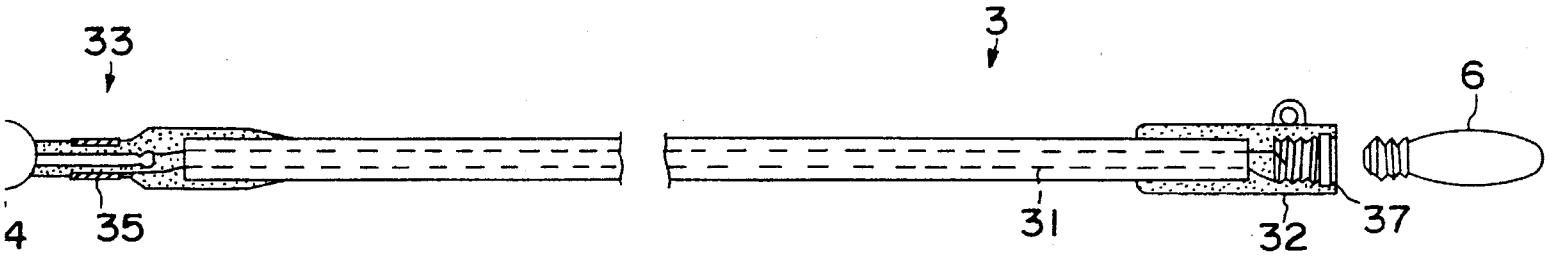
FIG. 5 is a schematic view showing the ribs in the embodiment of the present invention.

Referring to FIG. 5, there is shown a schematic view showing the the ribs in the embodiment of the present invention. The ribs 3 of the present invention are formed by embedding a pair of leads 31 in a rod made of a fiber glass reinforced plastic, one end thereof being provided with a socket 32 for installing a bulb 6, with a water resistant flange 37 being formed therebetween, and the other end of the ribs 3 being formed with a pivotal connection 33, the end of the pivotal connection 33 being formed into a ball shaped contact 34 and a rod shaped contact 35 being formed slightly rearwardly thereof and separated by an insulating layer wherein the leads 31 in the ribs 3 are connected to the pivotal connection 33 and the bulb socket 32.

Figure 6:
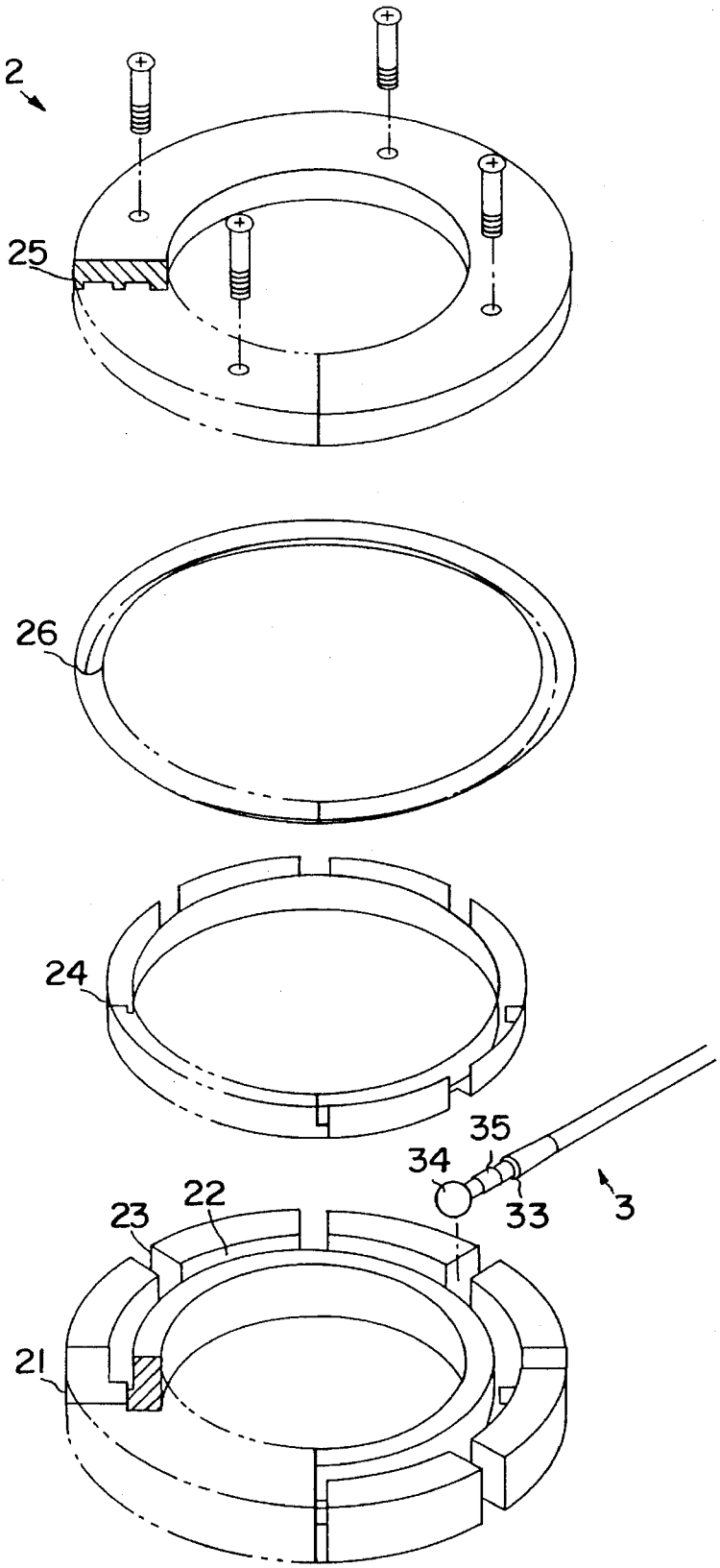
FIG. 6 is an exploded perspective view of the nest in the embodiment of the present invention.
Figure 7:
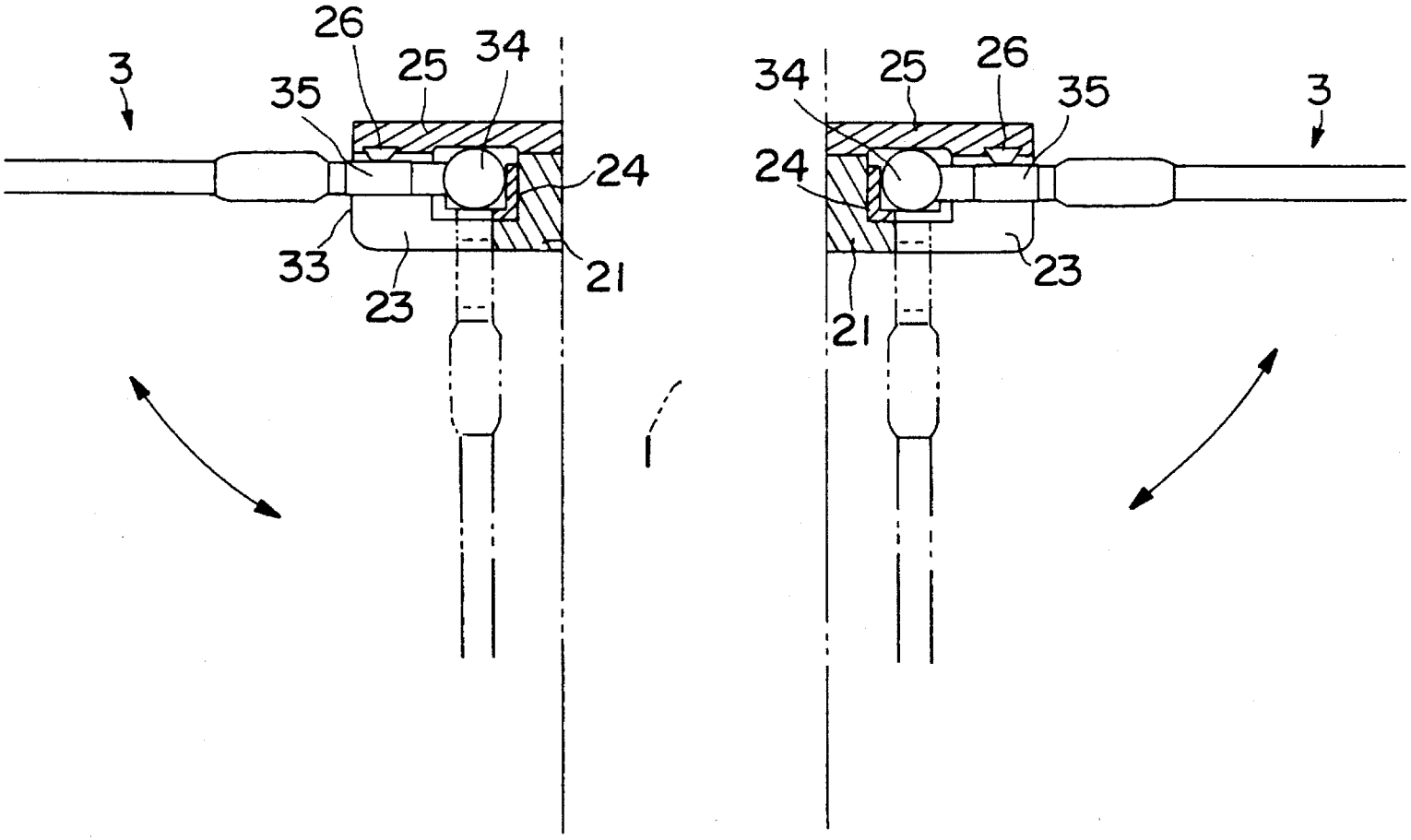
FIG. 7 is cross section view of the nest in the embodiment of the present invention.

Referring to FIG. 6, there is shown an exploded perspective view of the nest in the embodiment of the present invention. The nest 2 in the embodiment of the present invention comprises a nest seat 21, an inner conductive ring 24, a nest cap 25 and an outer conductive ring 26. The nest seat 21 is formed with an annular groove 22 which mates with the ball shaped contact 34 of the pivotal connection 33 on the tip of the ribs 3, the annular groove 22 being formed around the periphery with a plurality of notches 23 which fit around the neck of the pivotal connection 33. The inner conductive ring 24 is mounted inside the annular groove 22 is formed with same notches mating with those of the nest seat 21. The nest cap 25 is installed over the top side of the nest seat 21 and is a disk body provided on the bottom side with the outer conductive ring 26 of semicircular cross section. To assemble the nest 2, the inner conductive ring 24 is first placed within the annular groove 22 of the nest seat 21, then the ball shaped contacts 34 on the ends of the pivotal connections 33 on the tips of the ribs are placed into the annular groove 22 such that the necks thereof are positioned just in respective notches 23. Then the nest cap 25 and the outer conductive ring 26 are placed on the top side of the nest seat 21 to become the configuration as shown in FIG. 7, the ball shaped contact 34 being always in contact with the inner conductive ring 24. In use, by stretching the ribs 3 open in the horizontal direction, the rod shaped contact 35 is brought into contact with the outer conductive ring 26 such that electrical energy can be delivered to the bulbs 6 on the tips of the ribs 3.

Figure 8:
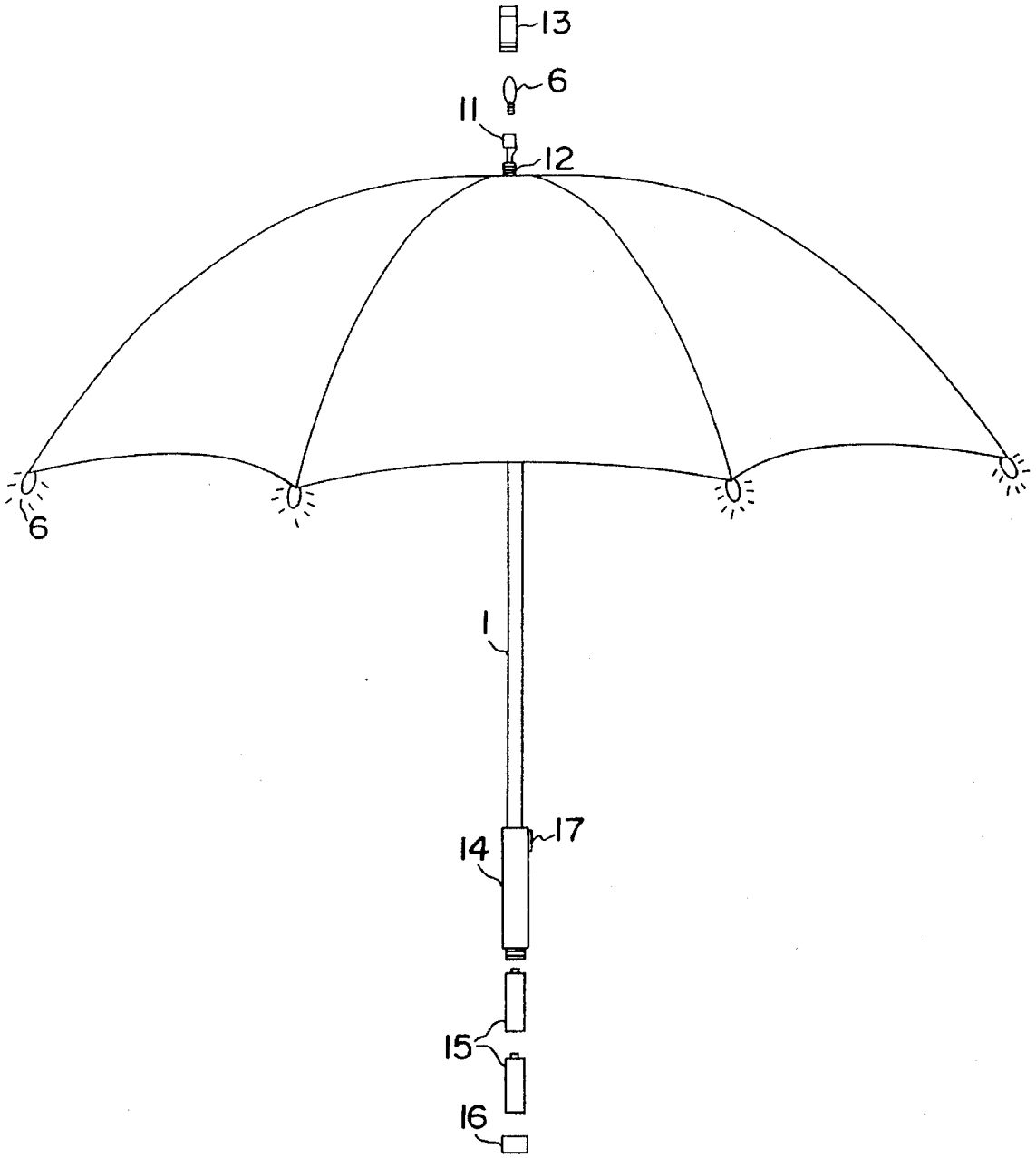
FIG. 8 is a schematic view of the shaft in the embodiment of the present invention.

Referring to FIG. 8, there is shown the schematic view of the shaft in the embodiment of the present invention. The shaft 1 in the embodiment of the present invention is provided on the top end with a bulb socket 11 for installing a bulb 6, male threads 12 being formed around the top end for a transparent lamp shade 13 to be screwed thereto. The shaft 1 is provided on the lower end with a handle 14 within which a space is defined for placing the battery cells 15 and the lower end is closed with a bottom cap 16. A switch 17 controlling the ON and OFF condition of the bulb 6 is disposed on the handle for convenient operation wherein electrical energy required for the bulb 6 on the top end of the shaft 1 is supplied by the cells by means of wires 7 via the switch 17.

The circuitry in the embodiment of the present invention is designed to have electrical power from the cells delivered directly to the bulb on the top end of the shaft via the switch and to the bulbs (or LEDs) on the tips of the ribs via the nest and the ribs. The two contacts between the nest and the ribs are engaged simultaneously only when the ribs are stretched open, and one of the contacts, the rod shaped contact and the outer conductive ring 26, is disengaged when the ribs are folded such that the switch on the handle can be used to control both the bulb on the top end of the shaft and the bulbs on the tips of the ribs when the umbrella is stretched open and to solely control the bulb on the top end of the shaft for use as a flashlight when the umbrella is folded.

Although a feasible embodiment of the present invention has been described in detail, it should be understood that various modifications and changes can be made by those skilled in the art without departing from the spirit and scope of the the present invention as defined in the appended claim.

What I claim is:

1. An umbrella with alarming and lighting functions comprising a plurality of ribs pivotally connected near the top end of a shaft by means of a nest, a water resistant cap placed on the top side of the nest, and pieces of fabric laid over the top side of the ribs, characterized in that:

said shaft is provided on the top end with a bulb socket for installing a bulb, male threads being formed around the top end for a transparent lamp shade to be screwed thereto, the shaft being provided on the lower end with a handle within which a space is defined for receiving battery cells and the lower end having a bottom cap, a switch being provided on the handle whereby electrical energy required for the bulb on the top of the shaft is supplied directly by the cells by means of wires via the switch;

said ribs comprise rods having electrical leads embedded therein one end thereof being provided with a socket for installing a bulb or LED and the other end thereof being formed with a pivotal connection, the end of the pivotal connection being formed into a ball shaped contact and a rod shaped contact being formed slightly spaced therefrom along said rib and separated by an insulating layer wherein the leads are connected to the pivotal connection and the bulb socket;

said nest comprises a nest seat, an inner conductive ring, a nest cap and an outer conductive ring, the nest seat having formed therein an annular groove which mates with the ball shaped contact of the pivotal connection on the ends of the ribs, the annular groove being formed around the periphery with a plurality of notches which fit around a neck of the pivotal connection, the inner conductive ring being mounted within the annular groove and formed with notches mating with said notches of the nest seat, the nest cap being installed over the top side of the nest seat and comprising a disk body provided on the bottom side with said outer conductive ring, whereby the ball shaped contact is in constant contact with the inner conductive ring such that in use by stretching the ribs open, the rod shaped contact is brought into contact with the outer conductive ring such that electrical energy is delivered to the bulbs on the tips of the ribs and whereby the switch on the handle is used to control illumination of both the bulb on the top end of the shaft and the bulbs on the tips of the ribs and to solely control the bulb on the top end of the shaft for use as a flashlight after the umbrella is folded whereby the rod shaped contact and the outer conductive ring are disconnected.

2. The umbrella of claim 1 wherein said ribs comprise fiber glass rods having a pair of electrical leads embedded therein with one lead connected to said ball shaped contact and the other lead connected to said rod shaped contact.

3. The umbrella of claim 1 wherein said ribs comprise rods of carbon fiber having a single electrical lead embedded therein.

4. An umbrella having alarm and lighting functions and comprising a plurality of ribs pivotally connected near the top end of a shaft by means of a nest, a water resistant cap placed on the top side of the nest, and pieces of fabric laid over the top side of the ribs, characterized in that:

said shaft comprises an illumination means at the top end, a handle at the bottom end with space defined therein for receiving at least one battery, a switch on said handle controlling electrical energy from said battery to said illumination means, and wires electrically connecting said battery, switch and illumination means;

said ribs comprise rods pivotally engaging said nest, each rib having an illumination means at an outer end, a pivotal connection means at an inner end, a pair of electrical contact elements associated with said pivotal connection means and electrical conducting means connecting said contact elements and said illumination means; and said nest comprises a nest seat, an inner conductive ring, a nest cap and an outer conductive ring, wherein said nest seat has formed therein an annular groove which receives said pivotal connection means of said ribs and which includes a plurality of notches formed around the periphery of said groove which notches receive said ribs when pivoted, said inner conductive ring is mounted within said annular groove in electrical connection with said battery and is formed with notches corresponding to said notches of said annular groove, said nest cap comprises a disk body having said outer conductive ring on the underside thereof whereby said outer conductive ring is in electrical connection with said battery and overlies said notches when said nest cap is secured to said nest seat, whereby one of said pair of electrical contacts of each rib is in constant electrical contact with said inner conductive ring and the other of said pair of electrical contacts is brought into electrical contact with said outer conductive ring upon pivoting of said ribs to an open position whereby electrical energy is delivered to said illumination means at the outer ends of said ribs and whereby electrical connection of said electrical contacts and said outer conductive ring is broken upon pivoting of said ribs to a closed position.

5. The umbrella of claim 4 wherein said illumination means on said shaft comprises an electrical socket and a bulb removably received therein, said socket having means to receive a transparent cover enclosing said bulb.

6. The umbrella of claim 5 wherein said pivotal connection means on each of said ribs comprises a ball end joined to said rib by a neck portion, said ball end sized to pivot within said annular groove of said nest seat and said neck portion sized to pass through said peripheral notches.

7. The umbrella of claim 6 wherein said pair of electrical contact elements comprise said ball end and an annular contact on said neck portion spaced from said ball and electrically insulated therefrom.

8. The umbrella of claim 7 wherein said illumination means of each rib comprises an electrical socket and a bulb removably received therein.

9. The umbrella of claim 7 wherein said ball end contact is in constant electrical connection with said inner conductive ring and said annular contact electrically connects to said outer conductive ring when said umbrella is opened and electrically disconnects from said outer conductive ring when said umbrella is closed.

10. The umbrella of claim 9 wherein said inner conductive ring is electrically connected to said battery by said switch.

11. The umbrella of claim 9 wherein said outer conductive ring is electrically connected to said battery by said switch.

12. The umbrella of claim 9 wherein said nest is electrically connected to said battery in a manner whereby said switch activates said illumination means on said shaft irrespective of the open or closed condition of said umbrella.

* * * * *